US006209371B1

(12) United States Patent
Guinn

(10) Patent No.: US 6,209,371 B1
(45) Date of Patent: Apr. 3, 2001

(54) PIPE BENDER ANGLE INDICATOR

(76) Inventor: Ricky Guinn, P.O. Box 1298, Flippin, AR (US) 72634

( * ) Notice: Subject to any disclaimer, the term of this patent is extended or adjusted under 35 U.S.C. 154(b) by 0 days.

(21) Appl. No.: 09/604,479

(22) Filed: Jun. 27, 2000

(51) Int. Cl.[7] ..... B21D 7/14
(52) U.S. Cl. ..... 72/31.05; 72/37; 72/459
(58) Field of Search ..... 72/31.04, 31.05, 72/37, 458, 459

(56) References Cited

U.S. PATENT DOCUMENTS

| | | | |
|---|---|---|---|
| 2,932,225 | | 4/1960 | Gardner . |
| 2,953,048 | | 9/1960 | Brown . |
| 3,063,314 | | 11/1962 | Benfield, et al. . |
| 3,245,201 | | 4/1966 | Richardson . |
| 3,396,565 | * | 8/1968 | Miller ..... 72/34.05 |
| 3,464,247 | * | 9/1969 | Beckwell ..... 72/37 |
| 3,590,617 | | 7/1971 | Mount . |
| 4,389,872 | | 6/1983 | Kowal . |
| 4,425,784 | | 1/1984 | D'Gerolamo . |
| 4,622,837 | | 11/1986 | Bergman . |
| 5,058,407 | | 10/1991 | Parker . |
| 5,144,823 | | 9/1992 | Wood . |
| 5,233,760 | | 8/1993 | Patterson . |
| 5,669,258 | | 9/1997 | Luebke . |
| 5,927,141 | | 7/1999 | Walsten . |

* cited by examiner

*Primary Examiner*—David Jones
(74) *Attorney, Agent, or Firm*—Polster, Lieder, Woodruff & Lucchesi

(57) ABSTRACT

An angle indicator is provided for use with a pipe bender and is adapted to be removably mounted to a handle of a pipe bender. The angle indicator includes a plate; a first wheel rotatably mounted to the plate and including a plurality of angle indicating marks evenly spaced about a periphery of the first wheel; a second wheel rotatably mounted to the plate concentrically with the first wheel; the second wheel being smaller in diameter than the first wheel and including a mark at a periphery of the second wheel, the mark being selectively alignable with one of the angle indicating marks of said first wheel; a bubble level mounted on the second wheel; a first lock to hold the first wheel in a desired rotational position; and a second lock to hold the second wheel in a desired rotational position. The use of two wheels allows for zeroing of the angle indicator and dialing in of the desired angle.

26 Claims, 2 Drawing Sheets

PIPE BENDER ANGLE INDICATOR

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to pipe benders, and, in particular, to an angle indicator for a pipe bender which can be mounted to the handle of a pipe bender.

Pipe benders have long been used by electricians to bend piping through which electrical wires pass. Such pipe benders, as is known, include a curved bending head or shoe which receives the pipe to be bent, and a handle which can be grasped by the electrician. To bend the pipe, the electrician simply places the pipe in the head, and pivots the head using the handle to bend the pipe. The pipe is bent around the curvature of the shoe until the desired angle of bend is reached.

When an electrician bends a pipe, he tries to achieve a particular angle, typically 45° or 90°. However, other size angles are often required. If a pipe is not bent to the desired angle (i.e., if the angle is overshot or undershot), then the pipe will not lay were desired, and the pipe may not lay flush against a surface, for example. This can impact wall construction in a building. It is thus desirable to enable electrician to determine as accurately as possible when a desired angle is reached.

Many different angle indicators have been developed. Many are incorporated into the head or shoe of the pipe bender. This obviously requires that a special mold be made for the pipe bender head, and thus increases the cost of the pipe bender. Further, when the angle indicator is built into the head, if the indicator should break, it cannot be replaced without replacing the entire head. For these reasons, pipe bender heads with angle indicators have not been well accepted by the industry.

Other angle indicators have been developed which clip to the handle of the pipe bender. These indicators are large, and thus difficult to use, or electric, and hence expensive.

BRIEF SUMMARY OF THE INVENTION

Briefly stated, an angle indicator of the present invention is intended for use with a pipe bender and is adapted to be removably mounted to the handle of the pipe bender. The angle indicator includes a mount adapted to mount the angle indicator to a handle of the pipe bender. Preferable, the mount is in the form of a spring clip, so that the angle indicator can simply be pressed onto the handle of the pipe bender and pulled off after the pipe has been bent.

A plate extends from the mount and first and second wheels are rotatably mounted to the plate. The second plate is smaller than the first plate and is mounted concentrically with the first plate. The first plate includes a plurality angle indicating marks evenly spaced about a periphery of the first wheel. The second plate includes a mark at a periphery of the second wheel. The second wheel mark is selectively alignable with one of the angle indicating marks of the first wheel.

A bubble level is mounted on the second wheel. The bubble level can either be a straight or a curved level. If it is a straight level, it is preferably extends across the second wheel in a line perpendicular to the mark on the second wheel. If the bubble level is curved, it can be mounted to the periphery of the second wheel, or along the edge of the second wheel.

A lock is provided to hold the first and second wheels in desired rotational positions. The angle indicator includes a bolt having a threaded shaft and a head at an end of the shaft. The threaded shaft is received in the plate and defines an axle about which the first and second wheels rotate. In the disclosed embodiment, the shaft extends through the plate, and a nut is received on the shaft on a back side of the plate. The bolt defines the lock. By tightening the bolt down, unwanted movement of the wheels are prevented and when the bolt is loosened, the wheels can be moved relative to each other.

The angle indicator is preferably also provided with a second lock, independent of the first lock, to locks the first wheel in place relative to the plate. The second lock includes a threaded shaft with an enlarged head on the shaft. The shaft passes through the plate adjacent the first wheel such that the head overlaps the first wheel. A nut is received on the shaft on the back side of the plate. When the second lock is tightened down, the head frictionally engages the first wheel to prevent unwanted movement of the first wheel relative to the plate.

In a second embodiment, the angle indicator includes only one wheel, on which a curved bubble level is mounted. The wheel includes a plurality of angle indicators at the periphery of the wheel, and the bubble level can be mounted on either side of the markings.

In a third embodiment, the lock for the for one or both of the wheels of the first embodiment or for the one wheel in the second embodiment, can comprise a ball and detent. In this situation, the axle about which the wheels rotate would be provided with a spring biased ball which radiates from the axle, and the wheel would be provided with detents (or similar structure) with which the ball would interact to hold the wheel in a desired position.

The advantage of either embodiment, is that the angle indicator allows for zeroing of the indicator. Hence, the indicator can be used with almost every pipe bender, no matter the angle between the pipe bender handle and the ground prior to bending of the pipe.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 3:
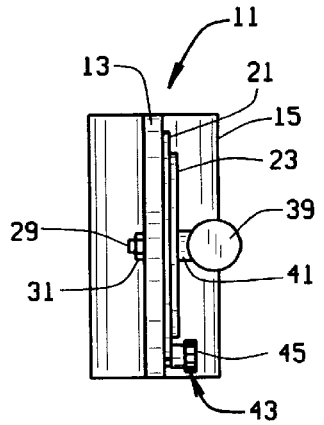
FIG. 3 is a end elevational view of the angle indicator.

A typical pipe bender 1 is shown in FIG. 3. The pipe bender 1 includes a head 3 having a curved shoe 5 and a stem 7 extending up from the shoe 5. A handle 9 is removably received in the stem 7 and can be grasped by an electrician to pivot the head 3 to bend a pipe as is known. The head 3 does not form any part of the present invention, and can be a conventional head. Not all pipe benders are made the same. Thus, the stem 7, and hence the handle 9, may not always extend from the shoe 5 at the same angle. Stated differently, the handle 9 of different pipe benders can form different angles with the ground when the pipe is received in the shoe, but before the pipe is bent.

Figure 4:
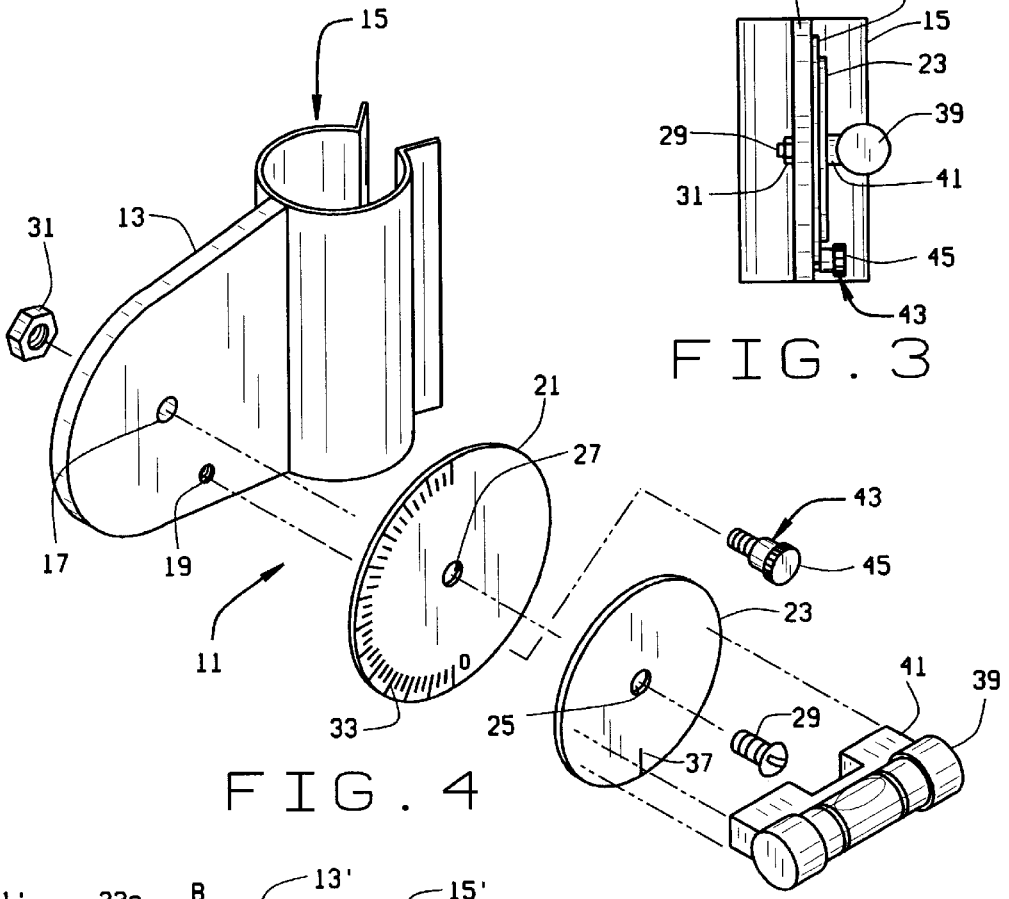
FIG. 4 is an exploded view of the angle indicator.

An angle indicator 11 of the present invention is shown mounted to the handle 9. The angle indicator 11 is shown in more detail in FIGS. 2–4. The angle indicator includes a backing plate 13 extending from a mounting clip 15. The clip 15 is shown to be a spring clip which spreads apart as it is pressed onto the handle 9, and then springs back to a normal position to grip the handle 9 to hold the indicator 11 in place on the handle 9. The clip 15 defines an arc which is slightly more than 180°, so that it can be pressed onto and grasp the handle 9 and so that it can be easily removed from the handle simply by pulling. Any other conventional type of mounting bracket could be used to removably secure the indicator 11 to the handle. For example, the mounting bracket could include a pair of spaced apart legs which are tightened together using a screw. Or, straps with Velcro could be used to mount the plate 13, and hence the indicator 11, to the handle 9. Alternatively, the clip 15 could include magnets to magnetically mount the indicator 11 to the handle 9.

The backing plate 13 includes a pair of holes, 17 and 19. A first wheel 21 and a second wheel 23 are rotatably mounted to the backing plate 13. The two wheels are mounted to the backing plate 13 with the first wheel adjacent the plate 13, and the second wheel 23 on top of the first wheel 21. As shown, the first and second wheels 21 and 23 each have a central hole 25 and 27, respectively, and a screw 29 passes through the central holes of the two wheels and through the hole 17 in the plate 13. A nut 31 on the back side of the plate 13 is used to tighten the screw 29 in place. As can be appreciated, the screw 29 defines an axle about which both wheels 21 and 23 rotate. Although a screw is provided, the second wheel 23 can be formed to include a threaded shaft extending from the back surface of the wheel to pass through the first wheel 21 and the plate 13 to receive the nut 31.

Although the screw is shown held in place by the nut 31, the hole 17 into which the screw 29 passes could be threaded, and the screw could be screwed into the plate 13. This would eliminate the need for the nut 31.

The first wheel 21 includes a plurality of angle markings 33 extending around the periphery of the wheel. The first angle marking is indicated to be at 0°. The angle markings 33 are shown to extend a full 1800 around the wheel 21 with larger markings showing increments of 15° and smaller markings showing increments of 5°.

Figure 1:
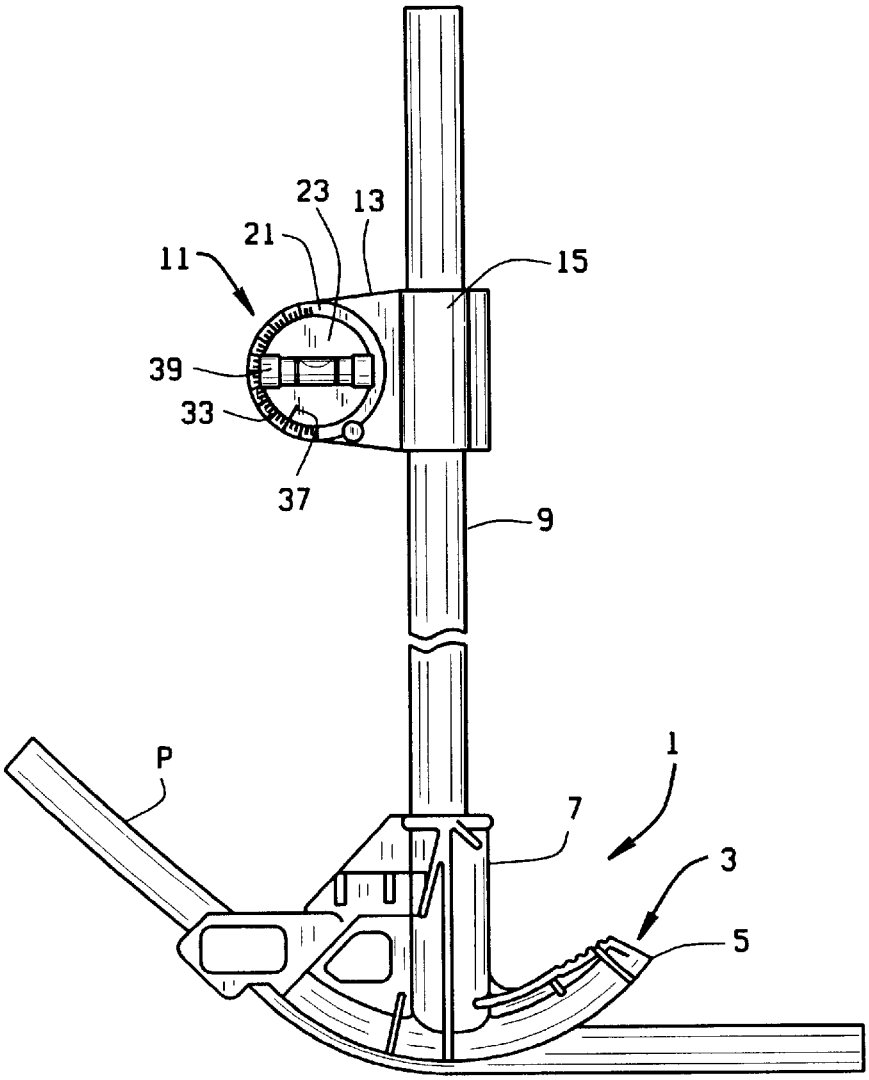
FIG. 1 is an elevational view of a pipe bender with an angle indicator of the present invention mounted to a handle of the pipe bender.
Figure 2:
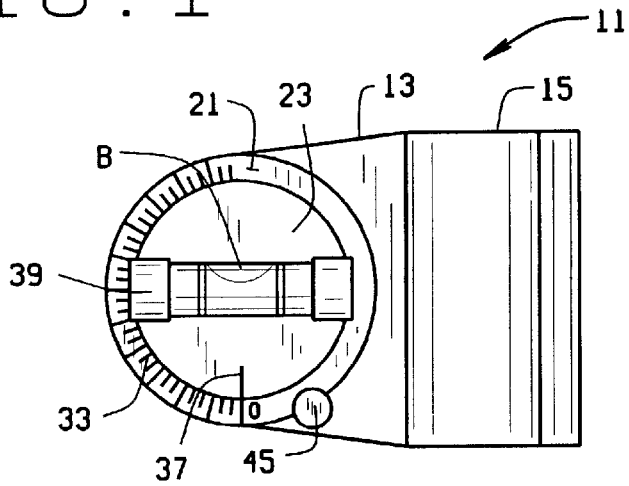
FIG. 2 is a front elevational view of the angle indicator.

The second wheel 23 is smaller in diameter than the first wheel 21 and includes a single indicating line 37. The second wheel 23 is sized so that the angle markings of the first wheel 21 are visible when the angle indicator 11 is assembled, as seen in FIGS. 1 and 2. A bubble or spirit level 39 is mounted to the second wheel 23. As shown, the level 39 extends across the diameter of the second wheel 23. Also, the level 39 is shown mounted to a spacer 41, which in turn, is mounted to the second wheel. The spacer 41 allows for clearance for the head of the screw 29. As can be seen, the bubble level is shown to be a straight level, and extends generally perpendicularly to the line 37.

A second lock screw 43 is received in the second hole 19 in the plate 13. The hole 19 is positioned, as seen in FIG. 2, so that the head 45 of the screw 43 overlaps the edge of the first wheel 21. The hole 19 can be a threaded hole which receives the screw 43. Alternatively, a nut can be received on the shaft of the screw 43 on the back side of the plate 13.

The first wheel 21 is directly against the plate 13 and the second wheel 23 is directly against the first wheel 21. As can be appreciated, when the nut 31 is tightened against the back surface of the plate 13, the two wheels are fixed in position, and can not be readily moved relative to each other. When the nut 31 is loosened, the two wheels can move relative to each other. The bolt 29 and nut 31 thus act as a lock to lock the wheels in position, as will be described below.

In operation, the angle indicator 11 is clipped to the handle 9 of the pipe bender 1. As noted above, with the spring clip 15, this is accomplished simply by pressing the mounting clip over the handle 9. The nut 31 which is threaded onto the shaft 29 and the lock screw 43 are loosened so that both the first wheel 21 and the second wheel 23 can rotate about the screw 29. The two wheels are not connected to each other and hence can rotate relative to each other.

After the pipe bender has been applied to the pipe, the first step is to zero the angle indicator. This is accomplished by rotating the second wheel until the bubble B in the level 39 is centered to indicate that the level 39 is horizontal or parallel to the ground. The first wheel is then rotated until its zero mark lines up with the line 37 on the second wheel 23. The zeroing operation can also be done by first lining up the zero mark on the first wheel with the line 37 on the second wheel 23 and then rotating the two wheels together until the bubble level indicates that the level is horizontal. The lock screw 43 is then tightened to lock the first wheel 21 in position.

The second wheel 23 is then rotated to line up its mark 37 with a desired degree mark 33 on the first wheel. Thus, for example, if a 25° angle is desired, the second wheel is rotated until the mark 37 lines up with the first wheel mark 33 corresponding to 25°. The nut 31 is rotated to tightened the screw 29 down to lock the second wheel 23 in position.

The lock screw 43 provide a separate lock for the first wheel so that the first wheel can be locked in position, and the second wheel can be rotated without fear of rotating the first wheel. However, because the second lock (i.e., the screw 29 and nut 31) holds both the first and second wheels in their desired positions, the lock screw 43 could be eliminated if desired.

Once the angle has been indicated, the electrician bends the pipe in the usual manner, keeping an eye on the level. When the level bubble is centered, to indicate that the level is horizontal, the desired bend for the pipe is reached, and the electrician can stop the bending process.

Although the angle indicator 11 is shown with a straight bubble level 39, a curved bubble level could be provided as well. The operation of the angle indicator would be the same.

Figure 5:
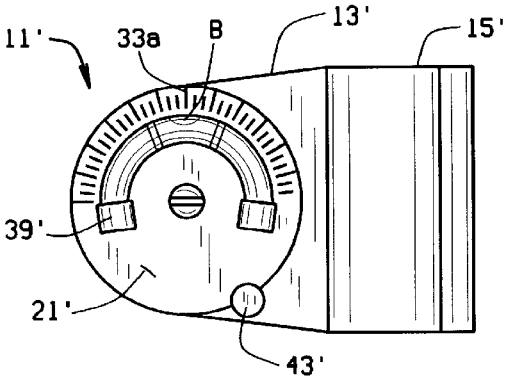
FIG. 5 is a front elevational view of an alternative embodiment for the angle indicator.

A second embodiment of the angle indicator is shown in FIG. 5. The angle indicator 11' includes a mounting clip 15' and plate 13' which are identical to the clip 15 and plate 13 of the indicator 11. However, rather than having two wheels, the angle indicator 11' includes only one wheel 21'. A plurality of angle indicating marks 33' are formed about the periphery of the wheel 21'. The marks 33' are shown to extend about 180" around the wheel, but could extend further if desired. A curved bubble level 39' is mounted to the wheel 21' inside of the marks 33'. Alternatively, the bubble level 39' could be mounted to the edge of the wheel 21'. The indicator 11' also includes a lock 43' identical to the lock 43 of the indicator 11.

In use, after the indicator 11' is clipped to the handle, the lock 43' is loosened and the wheel 21' is rotated until the bubble B is centered in the level 39', as shown in FIG. 5. This zeros the indicator and the wheel 21' can then be locked in place by tightening the screw 43'. The pipe is bent until the bubble lines up with the angle marking 33' corresponding to the angle of the desired bend. In the indicator 11', because the angle markings 33' are on the wheel 21', the mark 33*a* in the center of the markings will always correspond to 0°. As with the indicator 11, the markings 33' are spaced apart by 5°, with larger marks every 15°.

In the indicator 11', the angle markings 33' are on the wheel 21'. Alternatively, the markings 33' could be on the backing 13' adjacent the wheel. In this instance, the pipe bender must note which marking 33' the bubble B lined up with when the indicator 11' was zeroed. From that point, knowing that the markings 33' are separated by 5°, for example, the pipe bender can determine which marking the bubble B needs to line up with to arrive at the desired angle.

The angle indicator is designed to be small so that it can easily fit in a shirt pocket, tool belt, tool box, etc. For example, the first and second wheels can have diameters of about 2" and 1½ respectively. With wheels this size, the plate would be about 2" across and 2" tall, and the clip would be about 2" long. The indicator would have a height, from the bottom of the clip to the top of the plate of about 3". The indicator could be made smaller is smaller wheels were used.

The stems 7 of commercially pipe bender heads do not always extend up at the same angle. Thus, when a pipe bender is applied to a pipe, the handles from different heads will extend at different angles relative to the ground. The ability to zero the angle indicator 1 allows the angle indicator to be used with many different heads, and the angle of attachment of the handle 9 to the head 3 does not matter.

Figure 6:
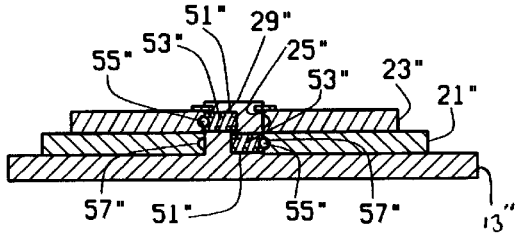
FIG. 6 is a cross-sectional view of a third embodiment of the angle indicator.

In another variation, at least the lock for the second wheel 23 of the indicator 11" could be replaced with a ball and detent or similar means, as seen in FIG. 6. In such an instance, for example, the screw 29 could be replaced with a post 29" which would serve as the axle for the wheels 21" and 23". The post 29" would include a short bore 51" into which a spring 53" and a ball 55" are placed, such that the spring biases the ball outwardly. The edge of the central opening 25" of wheel 23" would then be provided with a series of spaced apart detents 57". The spring biased ball 55" would interact with the detents 57" of the wheel to hold the wheel in the desired position. As can be appreciated, a lock could be provided for the wheel 21 or the wheel 21' of indicator 11'. The ball and detent could also be replaced with a short, but flexible finger extending from the post. The wheel(s) would be provided with grooves on the edge of their central openings. The finger would interact with the groove to hold the wheel in a desired position. Although the springs 53" and balls 55" are shown to be placed in the post 29" with the detent 57" in the wheels, the balls and detents could be reversed: the spring and balls could be received in the wheels and the detents could be formed about the post 29".

As can be appreciated, I have disclosed an angle indicator that has the advantage of being usable with any pipe bender, by merely zeroing the indicator for the particular pipe bender. In fact, once the angle indicator has been zeroed for use with a particular pipe bender, it need not be zeroed again. However, it would be advisable to periodically check the zeroing of the indicator to ensure that the wheel 23 has not moved. Additionally, because the indicator has the ability to dial in a desired angle, the angle of a pre-bent pipe can be duplicated without the need for knowing the angle of the bend in that pipe. The pipe bender, with the indicator thereon, is applied to the pre-bent pipe, and the wheel 23 (or 21' or 23") is rotated until the bubble is level. This will dial in the angle of the pre-bent pipe. Then, with the angle dialed in, the bender can be used, as described above, to form substantially identical bends in straight pipe. This bend can then be duplicated numerous times, without the need to reset the indicator.

As various changes could be made in the above constructions without departing from the scope of the invention, it is intended that all matter contained in the above description or shown in the accompanying drawings shall be interpreted as illustrative and not in a limiting sense. For example, the screw 29 can be replaced with a simple axle that is headed over on opposite sides to hold the two wheels 21 and 23 to the plate 13 and to allow the two wheels to rotate relative to each other. The angle indicator could be supplied with a second lock screw, similar to the lock screw 43, which would include a finger which would press down on the second wheel when the screw is tightened to lock the second plate in the desired position. Alternatively, the first wheel 21 can be provided with an arced slot through which a second bolt could extend. This second bolt would be the second lock which locks the second wheel in place. Alternatively, spring clips can be provided for one or both of the wheels which frictionally engage the wheels to hold them in the desired position. All that is required is that the two wheels 21 and 23 (of indicator 11) be able to rotate relative to each other, and that there be a locking mechanism for the two wheels of the indicator 11 or of the one wheel 21' of the indicator 11' so that the wheels can be secured in desired positions. These examples are merely illustrative.

What is claimed is:

1. An angle indicator for use with a pipe bender; the angle indicator including:

a mount adapted to mount the angle indicator to a handle of the pipe bender;

a plate extending from the mount;

a wheel rotatably mounted to the plate;

a bubble level mounted on the plate;

a plurality of markings representative of angles; and a lock to hold the wheel in a desired position relative to the plate.

2. The angle indicator of claim 1 wherein the bubble level is a curved level defining an arc of a circle.

3. The angle indicator of claim 2 wherein the angle markings are on a front face of the wheel; the bubble level being adjacent the angle markings.

4. The angle indicator of claim 1 wherein the angle markings are adjacent the wheel.

5. The angle indicator of claim 4 wherein the bubble level is curved defining the arc of a circle.

6. The angle indicator of claim 4 wherein the markings are on a second wheel; said second wheel being rotatably mounted to said plate and being concentric with said first wheel; said second wheel being rotatable relative to said first wheel.

7. The angle indicator of claim 6 wherein said first wheel includes a mark thereon, said first wheel mark being selectively alignable with a mark on said second wheel to dial-in an angle of a desired degree.

8. The angle indicator of claim 6 wherein said lock holds the second wheel in a desired position relative to said plate.

9. The angle indicator of claim 6 including a second lock to hold the second wheel in a desired position relative to said plate, but wherein said first plate can rotate relative to said second plate.

10. An angle indicator for use with a pipe bender; the angle indicator including:

a mount adapted to mount the angle indicator to a handle of the pipe bender;

a plate extending from the mount;

a first wheel rotatably mounted to said plate and including a plurality angle indicating marks evenly spaced about a periphery of said first wheel;

a second wheel rotatably mounted to said plate concentrically with said first wheel; said second wheel being smaller in diameter than said first wheel and including a mark at a periphery of said second wheel, said mark being selectively alignable with one of said angle indicating marks of said first wheel;

a bubble level mounted on said second wheel;

a lock to hold said first and second wheels in desired rotational positions.

11. The angle indicator of claim 10 wherein said bubble level is a straight tube bubble level.

12. The angle indicator of claim 11 wherein said mark on said second wheel is perpendicular to said bubble level.

13. The angle indicator of claim 10 including a bolt having a threaded shaft and a head at an end of said shaft; said threaded shaft being received in said plate and defining an axle about which said first and second wheels rotate; said bolt defining said lock, whereby, when said bolt is tightened, unwanted movement of said wheels is prevented and when said bolt is loosened, said wheels can be moved relative to each other.

14. The angle indicator of claim 13 wherein said bolt extends through said plate, said angle indicator including a nut which is received on said bolt shaft on a back side of said plate.

15. The angle indicator of claim 14 including a second lock which locks said first wheel independently of said second wheel.

16. The angle indicator of claim 15 wherein said second lock includes a threaded shaft with an enlarged head on said shaft; said shaft being received in said plate adjacent said first wheel such that said head overlaps said first wheel, whereby, when said second lock is tightened down, said head frictionally engages said first wheel to prevent unwanted movement of said first wheel relative to said plate.

17. The angle indicator of claim 16 wherein said shaft of said second lock extends through said plate; said second lock including a nut received on said threaded shaft on a back side of said plate, said nut being rotatable in one direction to loosen said lock and in an opposite direction to tighten said lock.

18. The angle indicator of claim 10 wherein said mount comprises a spring clip.

19. An angle indicator adapted to be removably mounted to a handle of a pipe bender; the angle indicator including:

a plate;

a first wheel rotatably mounted to said plate and including a plurality of angle indicating marks evenly spaced about a periphery of said first wheel;

a second wheel rotatably mounted to said plate concentrically with said first wheel; said second wheel being smaller in diameter than said first wheel and including a mark at a periphery of said second wheel, said mark being selectively alignable with one of said angle indicating marks of said first wheel;

a bubble level mounted on said second wheel;

a first lock to hold said first wheel in a desired rotational position; and a second lock to hold said second wheel in a desired rotational position.

20. The angle indicator of claim 19 wherein said first lock includes a threaded shaft with an enlarged head on said shaft; said shaft being received in said plate adjacent said first wheel such that said head overlaps said first wheel, whereby, when said first lock is tightened down, said head frictionally engages said first wheel to prevent unwanted movement of said first wheel relative to said plate.

21. The angle indicator of claim 20 wherein said shaft of said first lock extends through said plate; said first lock including a nut received on said threaded shaft on a back side of said plate, said nut being rotatable in one direction to loosen said lock and in an opposite direction to tighten said lock.

22. The angle indicator of claim 19 including a bolt having a threaded shaft and a head at an end of said shaft; said threaded shaft being received in said plate and defining an axle about which said first and second wheels rotate; said bolt defining said second lock, whereby, when said bolt is tightened, unwanted movement of said second wheel is prevented and when said bolt is loosened, said second wheel can be moved relative to said plate.

23. The angle indicator of claim 22 wherein said bolt extends through said plate, said angle indicator including a nut which is received on said bolt shaft on a back side of said plate.

24. The angle indicator of claim 22 wherein said first and second wheels are in contact with each other; said second lock, when tightened down, preventing movement of both said first and second wheels.

25. The angle indicator of claim 19 including an axle extending from said plate about which said wheel rotate; wherein at least one of said locks comprises a member extending from one of said axle and an edge of at least one of said wheels and a plurality of spaced apart indentations on the other of said axle and said at least one of said wheels; said member engaging said indentation to hold said wheel in a desired position.

26. The angle indicator of claim 25 wherein said member comprises a spring biased ball, and said indentations comprise detents.

* * * * *

UNITED STATES PATENT AND TRADEMARK OFFICE

CERTIFICATE OF CORRECTION

PATENT NO. : 6,209,371 B1
DATED : April 3, 2001
INVENTOR(S) : Guinn

It is certified that error appears in the above-identified patent and that said Letters Patent is hereby corrected as shown below:

Column 3,
Line 61, "1800" should read -- 180° --

Column 5,
Line 6, "180" should read -- 180° --

Signed and Sealed this

Eighth Day of January, 2002

*Attest:*

*Attesting Officer*

JAMES E. ROGAN
*Director of the United States Patent and Trademark Office*